US009371631B2

(12) United States Patent
Karlsson et al.

(10) Patent No.: US 9,371,631 B2
(45) Date of Patent: Jun. 21, 2016

(54) GROUND ENGAGING WEAR MEMBER AND MEANS OF MECHANICAL ATTACHMENT

(75) Inventors: Bjorn Marten Karlsson, Yangebup (AU); Bradley John Dallard, Lemming (AU); Wei Cheng Ong, Willetton (AU); Daniel Tuan Yong Foo, East Victoria Park (AU)

(73) Assignee: SANDVIK MINING AND CONSTRUCTION AUSTRALIA (Production/Supply) PTY LTD, Queensland (AU)

( * ) Notice: Subject to any disclaimer, the term of this patent is extended or adjusted under 35 U.S.C. 154(b) by 174 days.

(21) Appl. No.: 14/119,075

(22) PCT Filed: May 21, 2012

(86) PCT No.: PCT/AU2012/000564

§ 371 (c)(1),
(2), (4) Date: Mar. 5, 2014

(87) PCT Pub. No.: WO2012/159155

PCT Pub. Date: Nov. 29, 2012

(65) Prior Publication Data

US 2014/0173949 A1 Jun. 26, 2014

(30) Foreign Application Priority Data

May 20, 2011 (AU) ..... 2011901961

(51) Int. Cl.
*E02F 9/28* (2006.01)

(52) U.S. Cl.
CPC ..... *E02F 9/2883* (2013.01); *E02F 9/2825* (2013.01); *E02F 9/2833* (2013.01); *E02F 9/2858* (2013.01)

(58) Field of Classification Search
None
See application file for complete search history.

(56) References Cited

U.S. PATENT DOCUMENTS 2,524,652 A * 10/1950 Dalley ..... B26B 13/28 30/270
5,241,765 A 9/1993 Jones et al.

(Continued)

FOREIGN PATENT DOCUMENTS

AU 2010100656 A4 7/2010
CN 1780965 A 5/2006

(Continued)

OTHER PUBLICATIONS

Extended European search report dated Feb. 16, 2015 for corresponding European Application No. 12789871.6.

*Primary Examiner* — Jamie L McGowan
(74) *Attorney, Agent, or Firm* — Corinne R. Gorski

(57) ABSTRACT

A wear member assembly has a wear member, a wear member receiver with at least first and second contact portions and at least one aperture to receive at least one wear member locating member of the wear member. An attachment mechanism, releasably attaches the wear member to the receiver has at least one moveable attachment member and at least one respective fastening means. Actuation of each of the fastening means moves the associated attachment member to apply a retaining force to one of the contact portions of the receiver and causes the respective wear member locating member to apply a retaining force to the other of the contact portions of the receiver. At least one of the receiver first and second contact portions has a sloped or tapered face, and the corresponding wear member locating member or attachment member has a slope or taper, such that contact between the wear member locating member slope/taper or attachment member slope/taper and a corresponding one of the wear member receiver sloped/tapered contact portions causes the wear member to positively locate to the receiver when the releasable fastening means is actuated thereby releasably retaining the wear member to the outer surface of the earth moving apparatus member.

33 Claims, 22 Drawing Sheets

(56) References Cited

U.S. PATENT DOCUMENTS

| | | | | |
|---|---|---|---|---|
| 5,564,508 | A | 10/1996 | Renski | |
| 5,713,145 | A * | 2/1998 | Ruvang | E02F 9/2833 37/455 |
| 5,913,605 | A * | 6/1999 | Jusselin | E02F 9/28 172/772 |
| 6,240,663 | B1 | 6/2001 | Robinson | |
| 2003/0066215 | A1 | 4/2003 | Grant | |
| 2009/0304442 | A1 | 12/2009 | Dennis et al. | |

FOREIGN PATENT DOCUMENTS

| | | | |
|---|---|---|---|
| CN | 101326333 | A | 12/2008 |
| WO | 93/16239 | A1 | 8/1993 |
| WO | 2007/070929 | A1 | 6/2007 |
| WO | 2008119103 | A1 | 10/2008 |
| WO | 2011/156834 | | 12/2011 |

* cited by examiner 88
86
28, 80
48
46

90
44
42
86
87
28, 80
88

86
28, 80
33
87
88
90

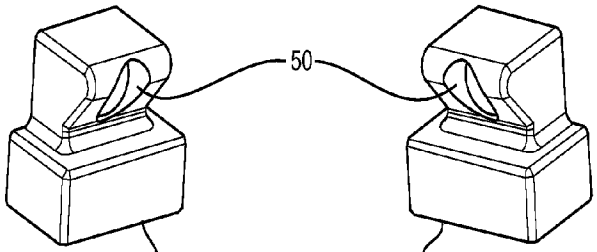
Fig. 12c
Fig. 12b
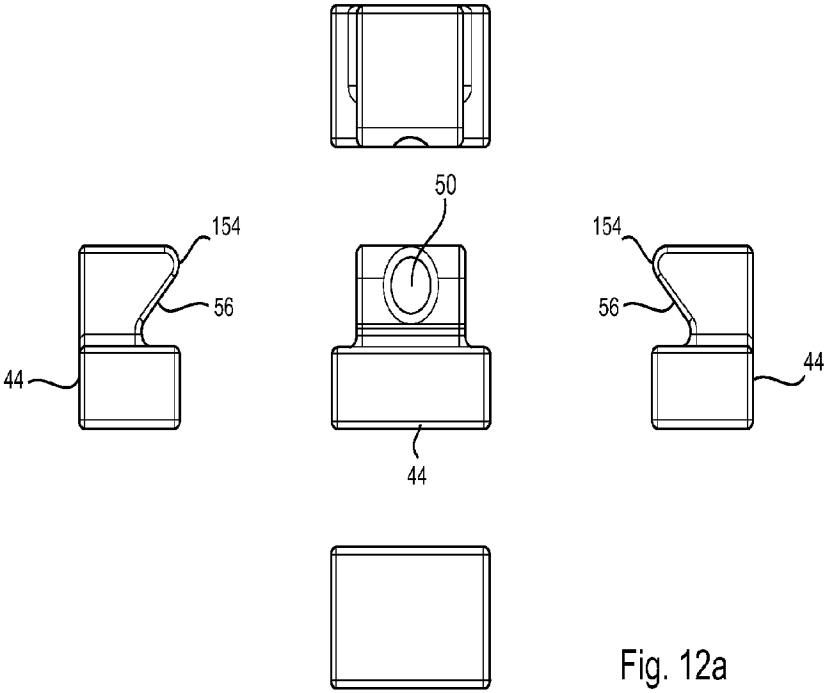
Fig. 12a

GROUND ENGAGING WEAR MEMBER AND MEANS OF MECHANICAL ATTACHMENT

FIELD OF THE INVENTION

The present invention relates to the attachment of wear members, such as heel shrouds, to surfaces subject to abrasive wear, such as earth moving buckets.

BACKGROUND TO THE INVENTION

Buckets for earth moving equipment, such as excavators, are subject to a high degree of abrasive wear. This wear is particularly pronounced at a leading edge of the bucket, where ground engaging tools such as adaptors and teeth are used to penetrate matter being dug. It is also found at bucket corners and heels, although wear in these areas is not as pronounced as at the leading edge.

In order to prolong the working life of a bucket, and to retain structural strength in the face of this wear, it is common practice to fix replaceable wear members to those parts of the bucket most subject to wear. Traditionally wear members such as teeth, wear strips and heel shrouds have been welded into place on a bucket.

Although the welding of wear members to buckets provides a secure means of attachment, it has significant practical difficulties. Replacement of worn members requires the cutting out of the worn member, and the fitting and re-welding of a new member in its place. Such metal-working operations require specialised equipment and trained boilermakers.

Where the bucket is being employed remotely, the removal of the bucket, transportation to a suitable workshop, replacement of the worn member and transportation back to the remote location can result in a significant time delay, and thus a loss of production. As excavators are often highly expensive, the underutilisation caused by the need for bucket repairs has a significant economic consequence.

In response to this problem, methods of mechanically attaching ground engaging tools to the leading edge of the bucket have been developed. An example of such a method is disclosed in the international patent application published as number WO02/12642, in the name of a predecessor of the present applicant.

Generally, known methods of mechanically attaching ground engaging tools to a bucket leading edge involve providing the ground engaging tool with a channel which locates about the bucket leading edge, and then clamping or bolting the ground engaging tool in a particular position along the bucket edge.

The geometry of this arrangement greatly assists in the attachment of ground engaging tools. The principle forces to which the tools are subjected are shear forces and compressive forces, and generally speaking these forces are transmitted directly to the bucket leading edge, rather than through the clamp or bolt being used. The mechanical attachment is thus only really required to prevent lateral movement of the tool along the bucket edge, or the pulling away of the tool from the bucket edge.

There have been relatively few attempts to provide a mechanical attachment of heel shrouds to excavator buckets. There would appear to be two reasons for this. Firstly, the rate of wear of heel shrouds is less than that of ground engaging tools, and thus the economic advantage of mechanical attachment, whilst significant, is not as great as for ground engaging tools at the bucket leading edge. Secondly, and perhaps more significantly, the geometry of heel shroud attachment is much less promising than at the bucket leading edge.

Heel shrouds must be mounted around corners or heels of the bucket. As such, there is no lip for them to clamp around. In other words, the angle included by a heel shroud is in the order of 90°, as opposed to an included angle of about 20° typical for ground engaging tools. Any force acting on the heel shroud, except for a direct compressive force, will act directly on the attachment system on at least one face. This places significant stress upon the attachment system. To date, therefore, welding has proved the only suitable method of attachment.

Research by the applicant has revealed an attempt to overcome this problem by bolting of heel shrouds to bucket corners and heels. This technique has several drawbacks. Firstly, the drilling of bolt holes within the bucket can reduce the bucket strength. Secondly, there is a tendency for bolts to deform under load. When this occurs, it can be impossible to remove a bolt using normal mechanical tools, and it may be necessary to cut the bolt from the bucket. This, of course, eliminates any advantage gained by the use of such bolts.

The present invention seeks to provide a means of mechanically attaching a heel shroud to an excavator bucket which does not require bolting through the bucket walls.

SUMMARY OF THE INVENTION

In accordance with a first aspect of the present invention there is provided a wear member assembly providing attachment of a wear member to a wear member receiver on an outer surface of an earth moving apparatus member, the wear member assembly including a wear member, a wear member receiver having at least first and second contact portions and at least one aperture to receive at least one wear member locating member of a wear member assembly, a releasable attachment mechanism arranged to releasably attach the wear member to the receiver, including at least one moveable attachment member and at least one respective fastening means such that actuation of each of the fastening means moves the associated attachment member to apply a retaining force to one of the contact portions of the receiver and causes the respective wear member locating member to apply a retaining force to the other of the contact portions of the receiver, at least one of the receiver first and second contact portions has a tapered face and the corresponding wear member locating member or attachment member has a taper such that contact between the wear member locating member taper or attachment member taper and a corresponding one of the wear member receiver tapered contact portions causes the wear member to positively locate to the receiver thereby releasably retaining the wear member to the outer surface of the earth moving apparatus member.

In accordance with a further aspect of the present invention there is provided a wear member assembly for attachment to a wear member receiver provided on an outer surface of an earth moving apparatus member, the wear member receiver having at least first and second contact portions and an aperture to receive a wear member locating member of a wear member assembly, the wear member assembly including a releasable attachment mechanism arranged to releasably attach the wear member to the receiver, the wear member assembly having a moveable attachment member and a fastening means such that actuation of the fastening means moves the attachment member to apply a retaining force to one of the contact portions of the receiver and causes the wear member locating member to apply a retaining force to the other of the contact portions of the receiver, at least one of the receiver first and second contact portions has a tapered face and the wear member locating member or the attachment member has a corresponding taper such that contact between the wear member locating member taper or the attachment member taper and a corresponding one of the wear member receiver tapered contact portions causes the wear member to positively locate to the receiver thereby releasably retaining the wear member to the outer surface of the earth moving apparatus member.

The invention has been envisaged with the earth moving apparatus member being a bucket, such as an excavator bucket, the outer surface being a bucket corner or bucket heel and the wear member being a heel shroud. The base portion may be the floor of the bucket, or may be the curved, rear portion of the bucket.

Both the wear member locating member and the attachment member may have a respective tapered contact surface or face, and the receiver may have respective tapered first and second contact portions, preferably being surfaces or faces, such that actuation of the fastening means causes the locating member and the attachment member to lift and positively retain the wear member to the wear member receiver.

Tapered contact urges the wear member locating member and attachment member to move (preferably to slide) relative to the tapered first and second contact portions (surfaces or faces) of the receiver and move upwards thereby causing the wear member to be retained to receiver located on the earth moving apparatus member.

The tapered face(s) ensures that the wear member is lifted to positively mate against the wear member receiver. The wear member receiver may otherwise be known or called an adapter because it allows the mounting parts of the wear member to connect the wear member to the earth moving apparatus (e.g. bucket). This is important when impact is directed through the wear member (heel shroud) so that all forces transfer to the earth moving apparatus without loose movement of the wear member that might otherwise damage the wear member, earth moving apparatus or the connection between the two.

Although the present specification uses the terminology "taper", "tapered" or "tapered face(s)", it is to be understood that such references include terms such as "chamfer" and "chamfered". The "taper" defines the locating member and the attachment member as having an overhang or broader top that narrows further down to the respective base. This "taper" may provide a flat face or convoluted face.

The wear member may include an aperture to receive therethrough at least part of the wear member attachment member. This enables the wear member attachment member to extend into the aperture of the wear member receiver for engagement therein.

The wear member locating member may have a bearing surface against which a portion of the fastening means bears and applies a force.

The fastening means may include one or more screw thread fasteners, such as bolts.

The through aperture of the wear member receiver may be bounded at opposed sides thereof by side portions. One or more of these side portions may include a respective projection portion, the projection portion arranged to support a corresponding wear member locating member projection. The projection portion of the respective side portion may be formed by a step in the material of the side portions. The projection(s) assists in initially locating the wear member to the wear member receiver and subsequently initially holding the wear member loosely in place until the fastening means is tightened.

The wear member attachment member may include a moving member or locking member, such as a sliding nut), which may include the attachment member tapered face. In use, the attachment member may move away from the locating member so as to expand the effective size of the attachment and locating members of the wear member assembly. Thus, these components may act as an adjustable boss to releasably attach the wear member to the receiver.

The wear member receiver may be welded or otherwise fastened to the underside of the earth moving apparatus. Alternatively, the wear member receiver may be formed integral with the earth moving apparatus.

The wear member may include a wear member body having a main body portion that, in use, mounts to an underside of the earth moving apparatus, and optionally a side body portion that, in use, extends at least partway along a side of the earth moving apparatus. The wear member body main and side body portions may be formed as a one piece components, such as by casting metal.

The main and side body portions may form an internal corner generally at right angles, which corner may include a recess or channel therealong arranged to accommodate an external corner edge of the earth moving apparatus. This also reduces corner contact between the body and the earth moving apparatus directly at that corner and reduces potential for fracture due to working forces at the body internal corner, thus maintaining the life of the wear member.

The wear member may include multiple locating members, preferably two. One or more of the locating members may include a respective said tapered face. The wear member may include a corresponding aperture therethrough for each respective locating member. Each such aperture may receive therethrough a respective fastening means.

Each locating member may have one or more of the projections to aid in locating and initially retaining the wear member in position until fastened using the fastening means.

One or more of the wear member side portions may include a respective protruding portion to project, in use, into a corresponding recess in the wear member receiver or earth moving apparatus. This further helps to position the wear member to the receiver but also helps transfer working loads through the wear member to the earth moving apparatus to prevent the wear member being moved or removed from its attached position.

One or more of the locating members may have an oblique face, which may also be incorporated in the tapered face. The wear member receiver may have a respective corresponding oblique face. Thus, whilst the fastening means urges the locating member and therefore wear member longitudinally relative to the earth moving apparatus, forces through the contacting oblique faces urge the wear member to move laterally relative to the earth moving apparatus.

Likewise, one or more of the attachment members may also include an oblique face, which may be the tapered face. This further assists in ensuring the wear member positively locates and attaches to the earth moving apparatus.

The wear member may have at least one raised elongate wall or shoulder portion extending along one or more respective sides of the aperture. The at least one shoulder portion may act, in use, to transfer shock and/or load through the wear member to the earth moving apparatus, and may also provide additional wear member locating benefits. The wear member receiver may include a corresponding at least one shoulder portion receiving recess. Alternatively, or in addition, the shoulder portion(s) may be provided on the wear member receiver or earth moving apparatus, and the receiving recess(es) on the wear member. The shoulder portion(s) may be elongated and may be discontinuous or segmented in length.

The wear member may include a mounting grip or knuckle extending forward of the body. This mounting grip or knuckle provides a lifting/handling point for use in initially positioning or removing the wear member to/from the earth moving apparatus. This also may provide a degree of protection for the head of the fastening means within the aperture in the outside face of wear member.

The locating member (also known as a "boss") may have side projections to help engage with the receiver. The receiver may have a platform area around the aperture therethrough, the aperture for receiving therethrough the locating member. The platform may support the side projections of the locating member. This support helps sustain impact during loading of the earth moving apparatus (e.g. bucket).

At least one spacer may be provided to locate between the locating member and the attachment member. At least one of these spacers may have an aperture through which the fastening means passes.

The at least one spacer may provide friction to the fastening means. For example, the spacer may include an aperture including a friction material, such as nylon or other plastics or soft metal material, that provides some resistance to the fastening means coming undone through vibration or normal working forces. The friction material will hold the fastening means fastened until released when required.

BRIEF DESCRIPTION OF THE DRAWINGS

It will be convenient to further describe the invention with reference to a wear member, being a heel shroud in a preferred embodiment of the present invention. Other embodiments are possible, and consequently, the particularity of the following discussion is not to be understood as superseding the generality of the preceding description of the invention. In the drawings:

FIGS. 12*a* to 12*c* show views of an alternative form of attachment member according to an embodiment of the present invention.

Specific version of embodiments and components of the present invention will hereinafter be described.

DESCRIPTION OF PREFERRED EMBODIMENT

Figure 1:
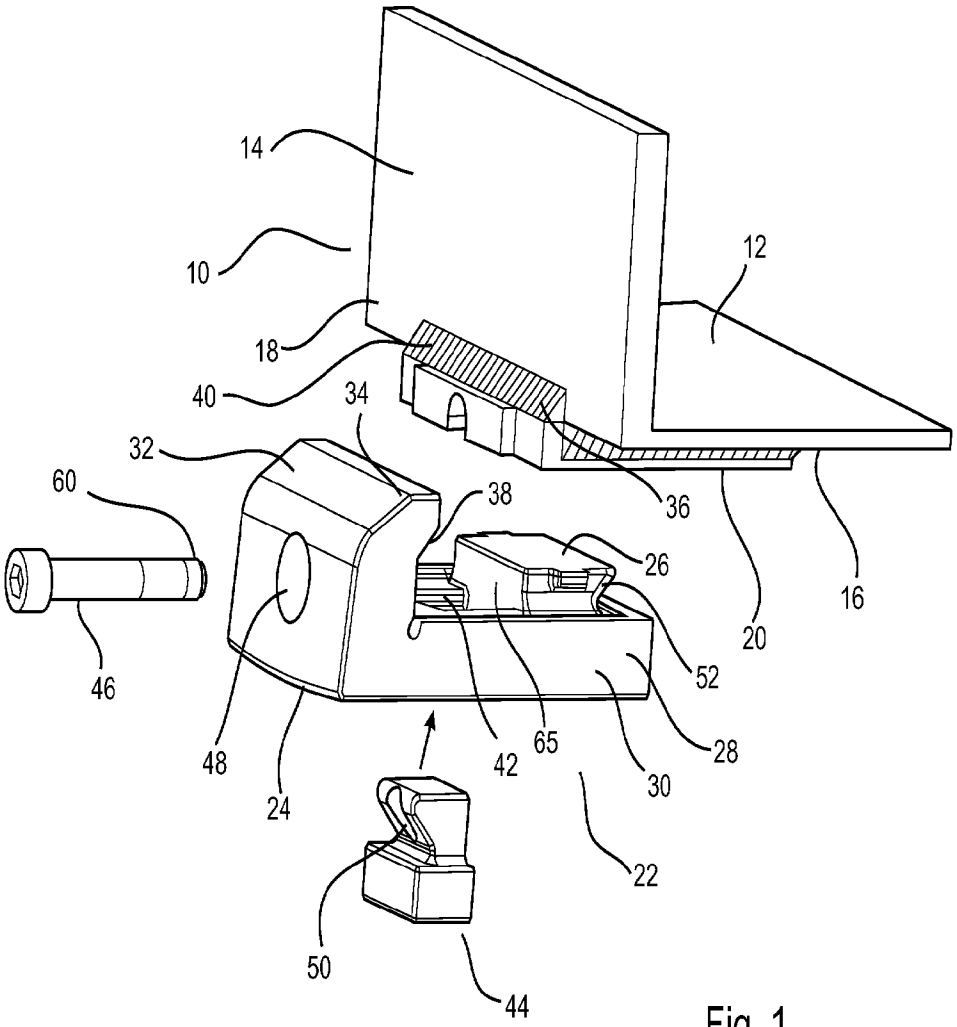
FIG. 1 shows an exploded view of components of a wear member assembly for mounting to an earth moving apparatus member according to an embodiment of the present invention.

FIG. 1 shows a portion of an excavator bucket corner 10 having an inner surface 12 and an outer surface 14. The outer surface 14 has a base portion or floor 16 which extends inwardly of the bucket leading edge (not shown), and a side portion 18.

The bucket corner portion 10 has a wear member receiver 20 affixed to the most outward part of the base portion 16 of the outer surface 14. In this embodiment of the present invention, the wear member receiver is welded to the bucket corner portion 10, but it will be appreciated that the receiver may be bolted, riveted or formed integrally with the bucket corner e.g. in a casting process. The receiver 20 has an aperture 78 arranged to receive therethrough at least a portion of a locating member 26 and attachment member 44.

A wear member assembly 22 includes a wear member 24 having a locating member 26 integral to a body 28 formed of a main body portion 30 and a side body portion 32 extending generally perpendicular to the main body portion. The side body portion may have a lip 34 arranged to engage over a shoulder portion 36 of the receiver.

The wear member has an aperture 42 through the main body portion that forms a base or platform section. An attachment member 44 is arranged to pass up through the aperture 42. A fastening means in the form of a bolt 46 is arranged to pass through an aperture 48 in a front face of the wear member. The bolt includes a thread that engages with an internal thread of an aperture 50 through the attachment member once the member is in place through the aperture 42 in the main body portion of the wear member. With the wear member 24 positioned against the receiver 20, a tapered contact face 52 on the locating member 26 engages with a corresponding tapered contact face 54 on the receiver. Rotation of the bolt causes the attachment member 44 to move away from the locating member. The attachment member has a tapered contact face 56 and to engage with a corresponding tapered contact face 58 on an inner surface of the receiver. A distal end 60 of the bolt 46 can have a contact end 62 that is free to rotate relative to locating member of the wear member. Alternatively, the fastening means (e.g. bolt 46) may be a one piece component. This contact end includes an impact head arranged to impinge against a rear face 64 of the locating member 26. It will be appreciated that as the bolt is rotated, the attachment member advances towards the side body portion of the wear member and impinges against the internal tapered contact face 56 of the receiver. This action also causes the locating member to be forced away from the attachment member as the bolt advances through the aperture of the attachment member by contact of the impact head 64 of the bolt against the forward contact face 65 of the locating member. The locating member is thereby forced into engagement against the tapered contact face 54 of the receiver. The arrangement of tapered faces and respective contact therebetween causes the wear member to lift up against the receiver to be positively held in place. This presents loose movement of the wear member and helps to ensure load forces are transferred effectively to the earth moving apparatus (e.g. a bucket or shovel) through the receiver, and reduces premature wear or failure of the assembly.

Figure 2B:
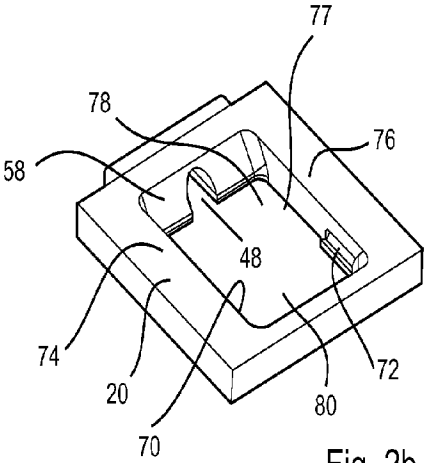
FIGS. 2*a* to 2*e* show components of the embodiment shown in FIG. 1.
Figure 2D:
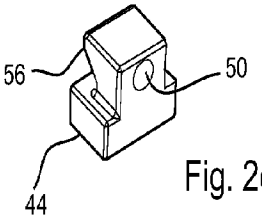
Figure 2E:
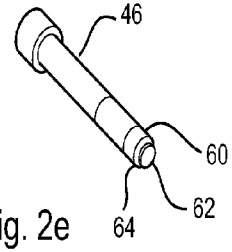
Figure 2A:
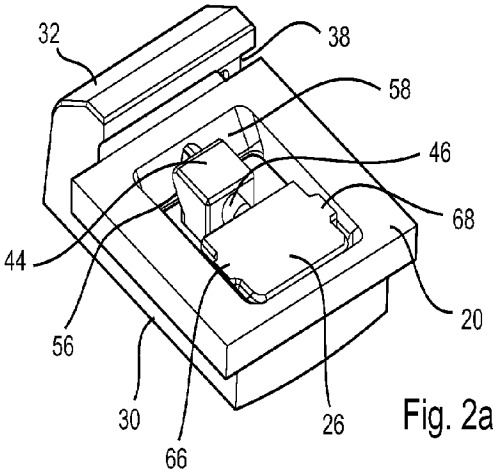
Figure 2C:
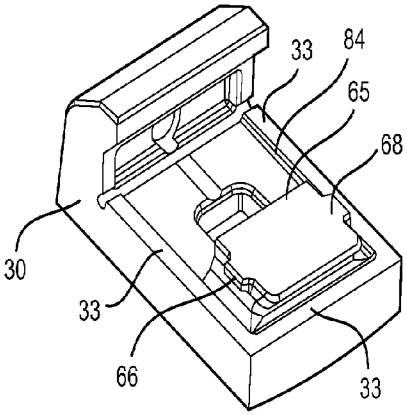
Figure 3B:
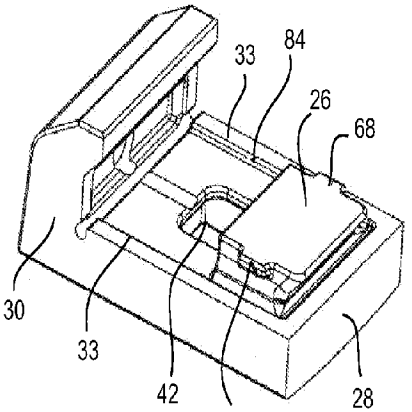
FIGS. 3*a* to 3*d* show a wear member of an embodiment of the present invention.
Figure 3D:
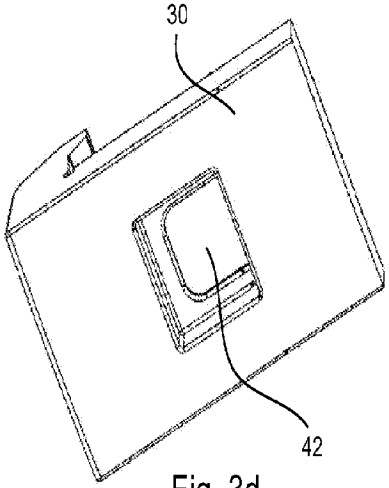
Figure 3A:
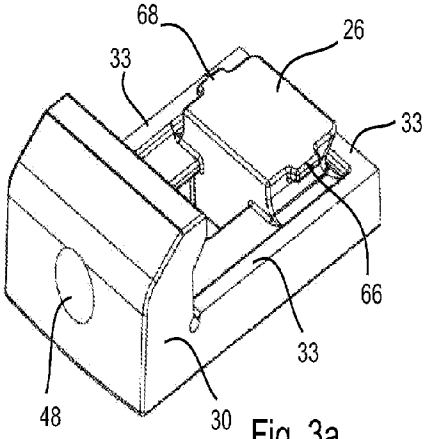
Figure 3C:
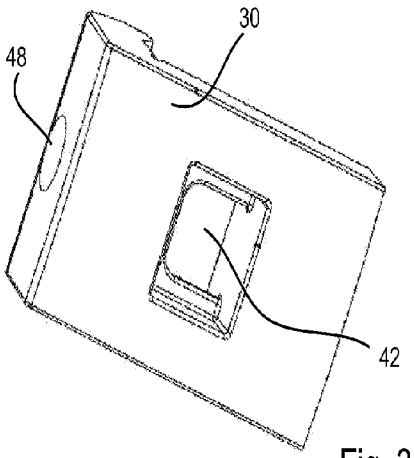

FIGS. 2*a* to 2*d* show an embodiment of the present invention assembled and as separate components. FIG. 2*a* shows the assembly mounted to a receiver 20. It will be understood that the receiver would be attached to the underside of earth moving apparatus, such as a bucket. The locating member 26 (also known as a 'boss') is engaged against a contact face 54 of the receiver. The attachment member 44 is engaged against an opposite contact face 58 of the receiver. The bolt 46 passes through the front face of the wear member 24, passing through the attachment member and impinging against the locating member.

The locating member has side projections 66,68. These side projections are supported on corresponding side projections 70,72 extending from side portions 74,76 of the receiver. In use, the wear member is initially presented up to the receiver such that the side portions 66,68 of the locating member 26 pass into the wider portion 77 of the aperture 78 and then the wear member moved so that the locating member side projections 66,68 are over the receiver side projections 70,72. This initially supports and stabilises the wear member whilst attachment member and fastening means are put into place and the wear member fully engaged in place. This arrangement of projections prevents the wear member dropping out until locked into place. The wear member 30 includes a force transfer face 33 on an upper surface of a wall portion 84 extending upwardly around the periphery of the main body.

FIGS. 3*a* to 3*d* show detail of the wear member 28 shown in FIG. 1.

Figure 4:
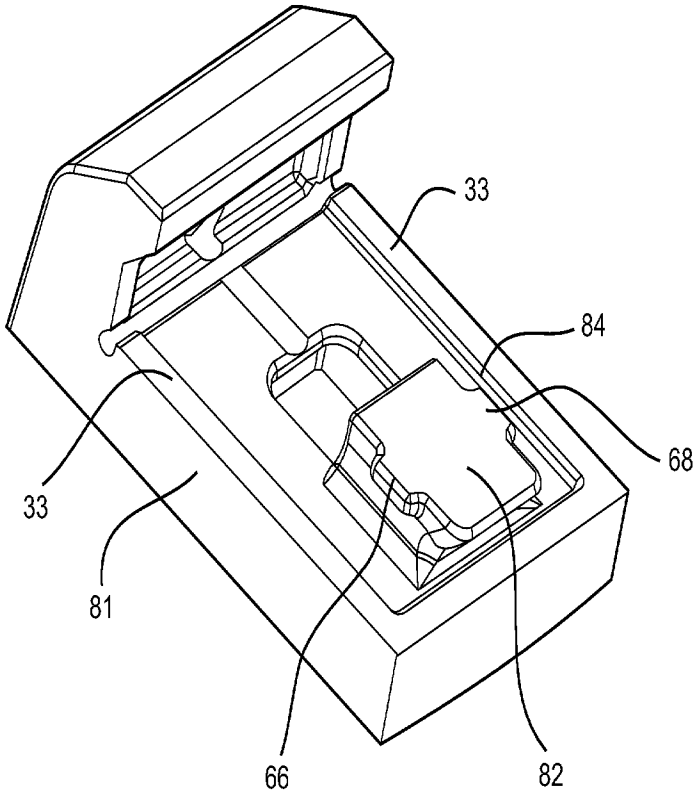
FIG. 4 shows an alternative form of wear member according to a further embodiment of the present invention.

FIG. 4 shows an alternative embodiment of a wear member 81 of the present invention. This wear member is similar to the wear member 28 shown in FIG. 1 except the locating member 82 is reduced in width compared to that in FIG. 1, and the main body 30 has a force transfer face 33 on a wall portion 84 extending upwardly around the periphery of the main body. In use, this force transfer face contacts against the receiving member to transfer load forces from the wear member to the earth moving apparatus. This helps to provide rotational support to the wear member.

Figures 5A, 5B, 5C:
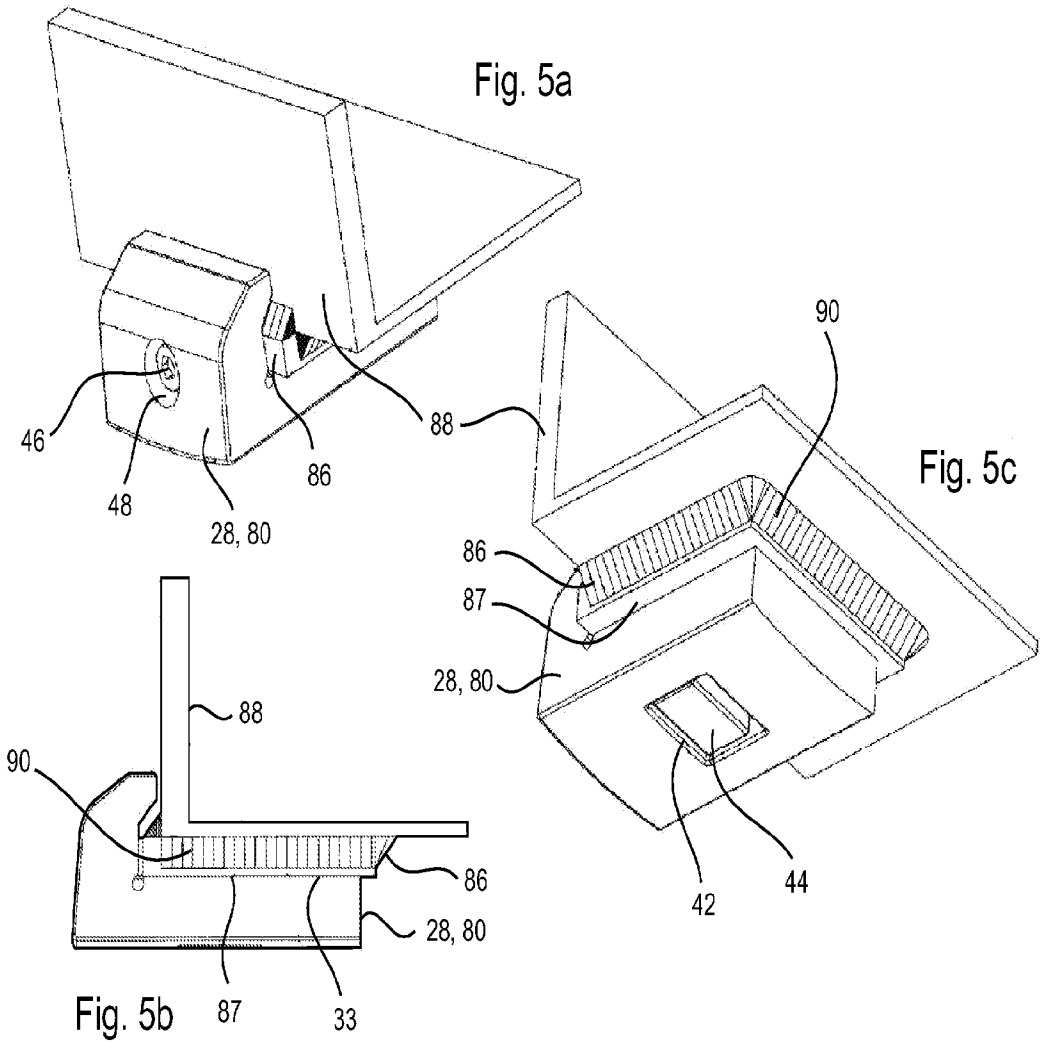
FIGS. 5*a* to 5*c* show a wear member assembly mounted to a receiver (adapter) according to an embodiment of the present invention.

FIGS. 5*a* to 5*c* show the wear member 28,81 mounted in place to a receiver 86 welded 90 on a corner 88 of a bucket. FIG. 5*b* shows a side view of the assembly in place against a bucket corner. In FIG. 5*b* is shown the force transfer face 33 contacting the receiving member face 87.

Figure 6:
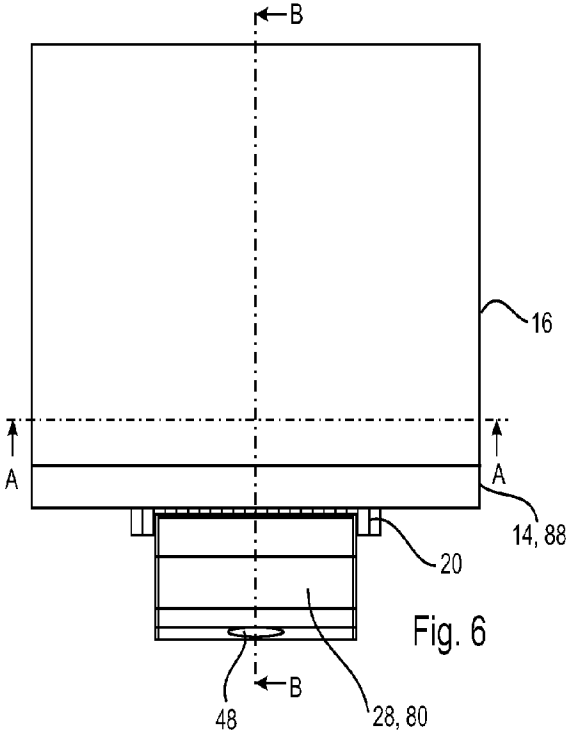
FIG. 6 shows a plan view of a wear member assembly mounted to the corner of a bucket of an earth moving apparatus.

FIG. 6 shows a plan view of a section of a bucket of an earth moving apparatus, with the wear member 28,81 mounted in position to a receiver 20,86 welded to the underside of the bucket external surface.

Figure 7B:
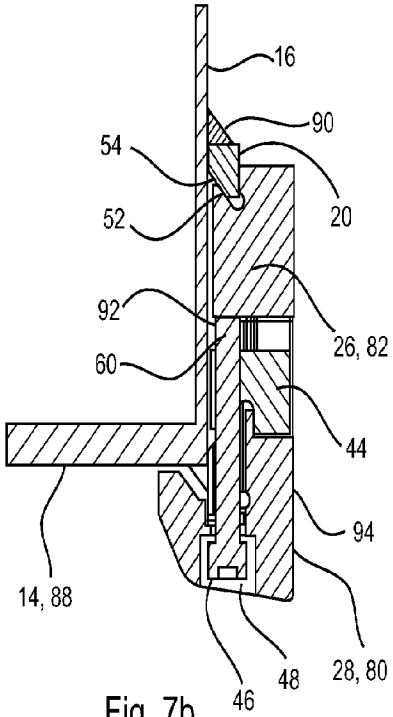
FIGS. 7*a* and 7*b* show sectional views A-A and B-B through the embodiment shown in FIG. 6.
Figure 7A:
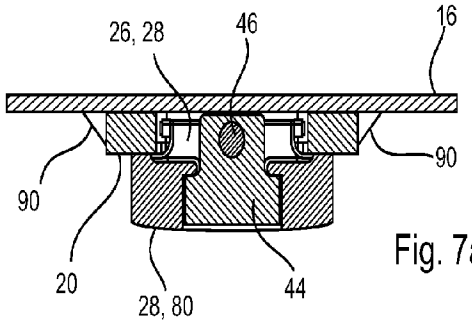

FIG. 7*a* shows a sectional view taken through section line A-A of FIG. 6. FIG. 7*b* shows a sectional view taken through section line B-B of FIG. 6. The locating member 26,82 tapered contact face 52 is seen engaged against the corresponding tapered contact face 54 on the receiver. Rotation of the threaded bolt 46 causes the attachment member 44 to move away from the locating member face 64. As the bolt advances through the attachment member, the distal end of the bolt 60 impinges against a contact surface 92 of the locating member. As the attachment member contacts and pushes against the receiver, this causes the locating member to more positively engage against the receiver, thereby locking the wear member to the receiver. Release of the bolt by counter rotation causes the attachment member to move back towards the locating member, thereby allowing the wear member to be released from the receiver for repair or replacement. Once the bolt is removed from the attachment member, the bolt can be drawn out through the front aperture 48 of the wear member and the attachment member withdrawn through the aperture 42 in the base 94 of the wear member. Thus components of the assembly can be replaced if they are worn or damaged, or otherwise reused.

Figure 8:
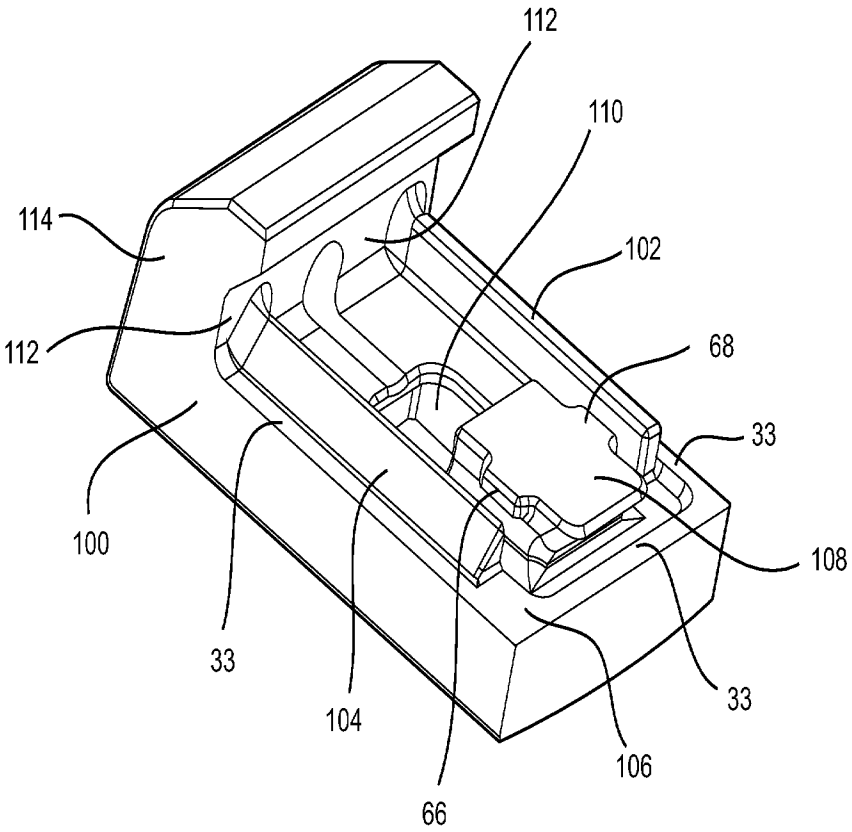
FIGS. 8, 9 and 10 show alternatives form of wear member according to further embodiments of the present invention.

FIG. 8 shows an alternative embodiment of a wear member 100. Elongate projections 102,104 extend from the inner face 112 of the side body portion 114 along the sides of a recessed platform area 106 adjacent the locating member 108 and aperture 110 of the wear member. These wall or shoulder elongate projections are provided to extend into corresponding channels in the receiver to further positively locate and stabilise the wear member when mounted to the receiver. One of the elongate projections 104 has a taper or angled face 105. This angled face may receive a resilient material, such as rubber or a rubber like material, to provide a more forgiving tolerance than plain metal alone. This arrangement also assists in transferring load forces to the bucket through the receiver, and assists in reducing damage from shear forces through the wear member.

Figure 9:
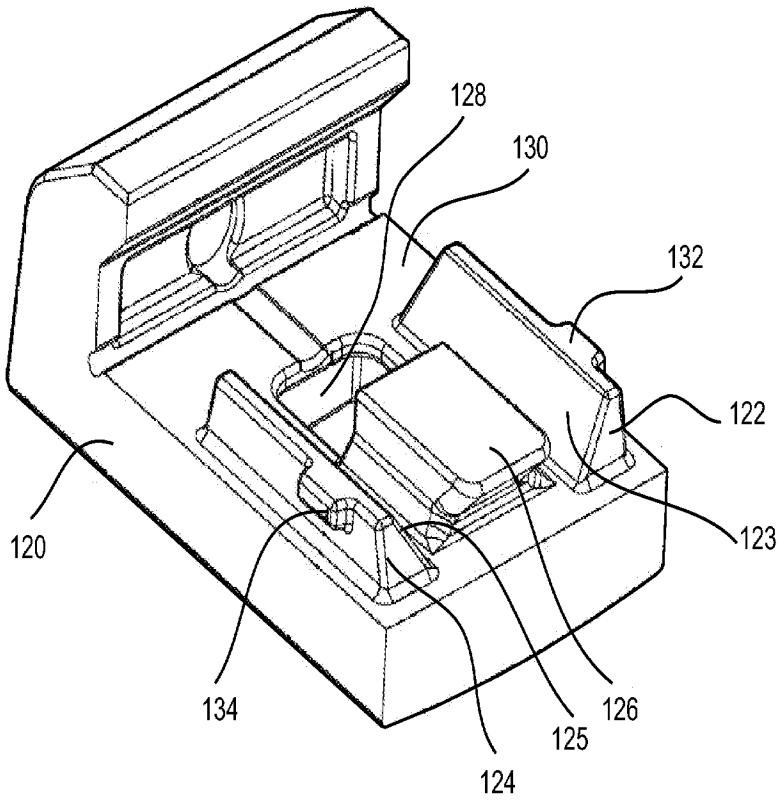

FIG. 9 shows an alternative embodiment of the wear member 120. The wall or shoulder elongate projections 122,124 are shorter in elongate extent than the corresponding projections in FIG. 8. These extend approximately the longitudinal extent of the locating member 126 and the aperture 128. The wall or shoulder elongate projections 122,124 each has a taper face 123,125. The platform area 130 in this embodiment is not recessed; however the recessed platform arrangement may be adopted. The wall or shoulder elongate projections 122,124 have side projections 132,134, each arranged to locate within a respective recess formed between the receiver and underside of the bucket, or within the receiver. This helps to initially locate and hold the wear member to the receiver, and provides an alternative or additional support mechanism to the side projections 66,68 on the locating member, similar to projections 70,72 of the receiving member.

Figure 10:
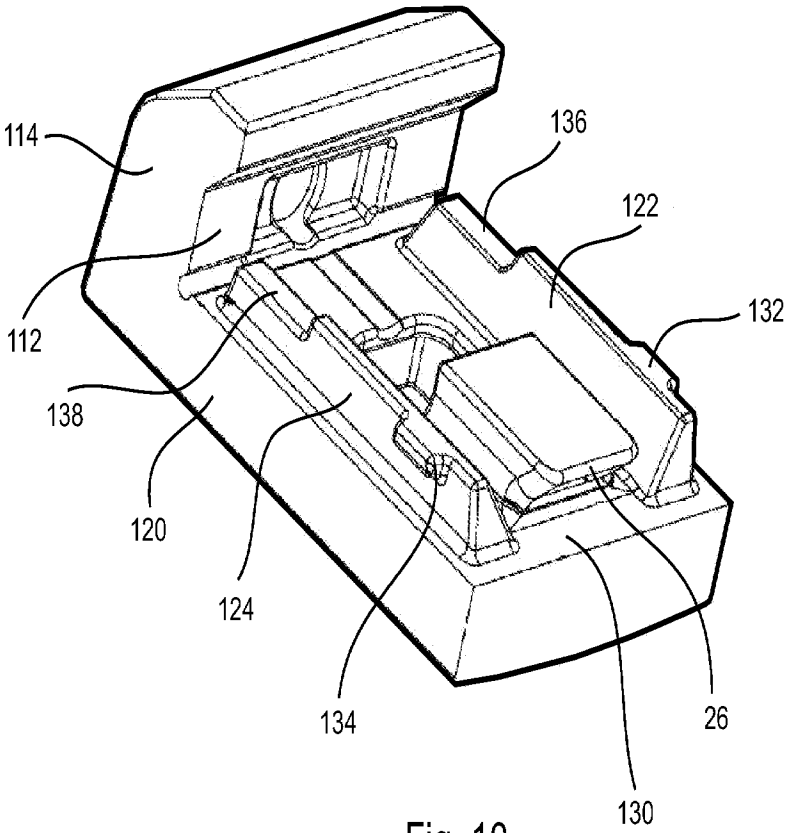

The wear member shown in FIG. 10 is similar to that shown in FIG. 9; however the wall or shoulder elongate projections 122,124 extend along a majority of the platform area 130 without meeting the interior surface 112 of the side body portion 114.

Figure 11A:
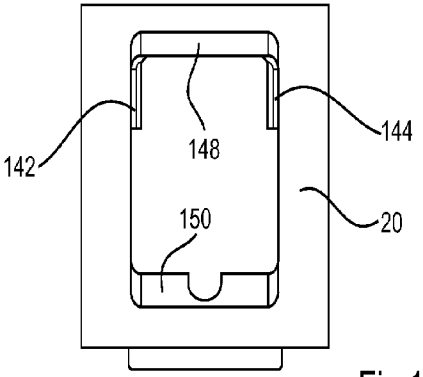
FIGS. 11*a* to 11*e* show alternative forms of a wear member receiver according to an embodiment of the present invention.
Figure 11B:
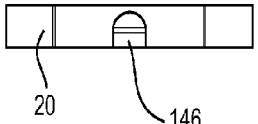
Figure 11C:
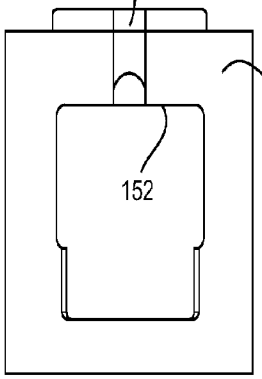
Figure 11D:
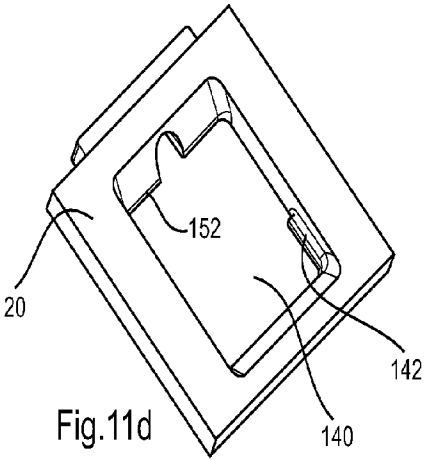
Figure 11E:
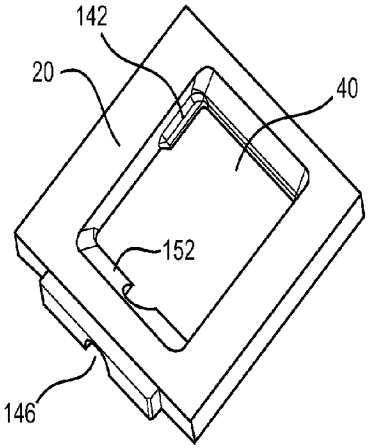

FIGS. 11*a* to 11*e* show various views of an embodiment of a receiver 20 of the present invention. FIG. 11*a* is a top, plan view, FIG. 11*b* a front end view, FIG. 11*c* a bottom view, and FIGS. 11*d* and 11*e* are perspectives. Side projections 142,144 are shown extending into the receiver aperture 140. The receiver includes an arcuate channel 146 to accommodate the fastening means (e.g. bolt) when the wear member is mounted to the receiver. The receiver includes a receiver rear tapered contact face 148 for mating with the tapered contact face of the locating member. The receiver also includes a front tapered contact face 150 for the attachment member to locate against.

An embodiment of the attachment member 44 is shown in FIGS. 12*a* to 12*c*. FIG. 12*a* shows top, bottom, front and respective side views of the attachment member. The attachment member is essentially a nut with a threaded through aperture arranged to engage with a corresponding thread on the bolt 46 (FIG. 2*e*) so that the attachment member moves along the bolt when the bolt is rotated one way or the other. The attachment member has a tapered face 56 arranged to engage over a lip 152 of the receiver. Preferably the attachment member tapered contact face 56 contacts a corresponding tapered face 150 of the receiver. However, it will be appreciated that the overhang 154 is sufficient to allow the attachment member to engage with a portion of the receiver bounding the receiver aperture 140 and prevent the wear member releasing from the receiver until the fastening means is released.

Figure 13:
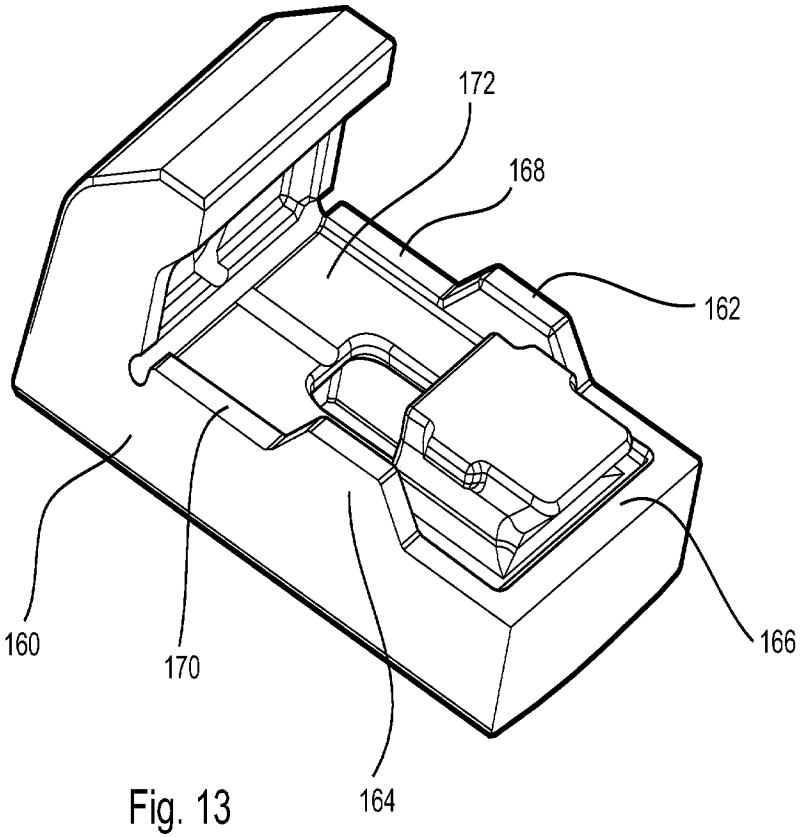
FIG. 13 shows an alternative form of the wear member according to a further embodiment of the present invention.

FIG. 13 shows an alternative embodiment of the wear member 160. This embodiment includes bevelled extensions 162,164 of the bounding periphery 166 of the wear member. This bounding periphery 166 bounds a recessed platform 172. The bevelled extensions 162,164 project from peripheral raised edges 168,170 of the bounding periphery 166. These bevelled extensions assist in locating the wear member correctly to the receiver, which would have corresponding (bevelled) recesses either side thereof.

Figure 15B:
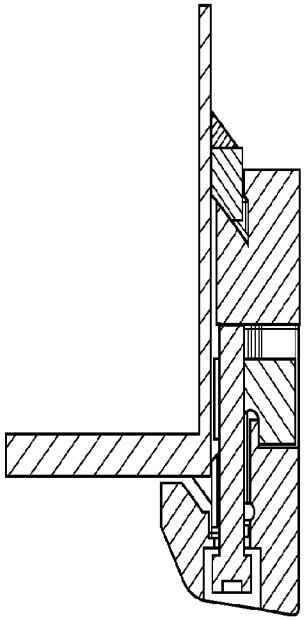
FIGS. 15*a* and 15*b* show sectional views A-A and B-B through the embodiment shown in FIG. 6.
Figure 14:
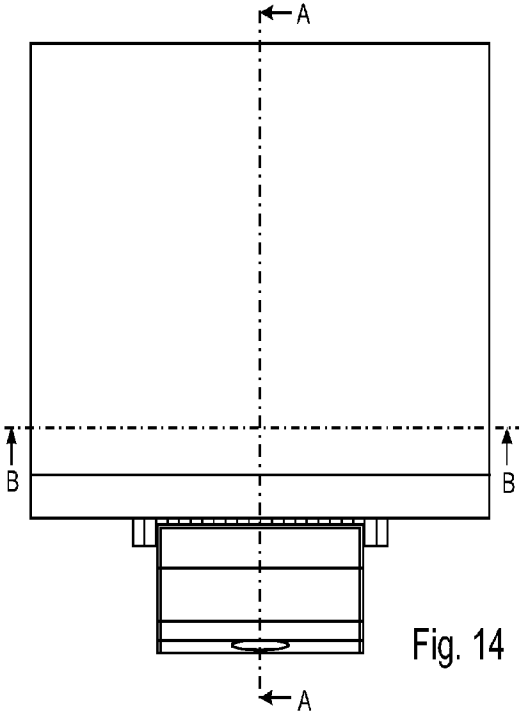
FIG. 14 shows a plan view of an alternative wear member assembly mounted to the corner of a bucket of an earth moving apparatus.
Figure 15A:
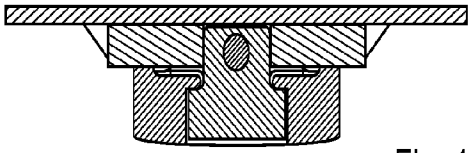

FIGS. 15*a* and 15*b* are respective sectional views taken along section lines A-A and B-B of FIG. 14 showing detail of an embodiment of an assembly according to the present invention.

Figure 16C:
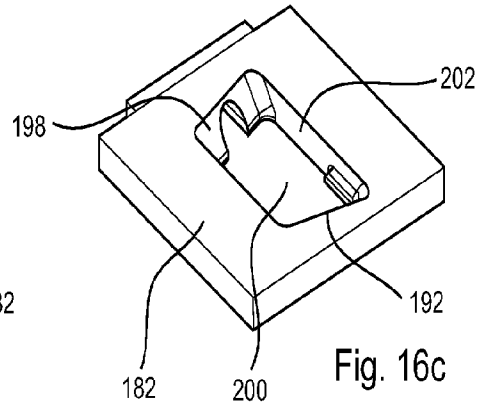
FIGS. 16*a* to 16*e* show an assembled wear member assembly and individual components of that assembly according to a further embodiment of the present invention.
Figure 16D:
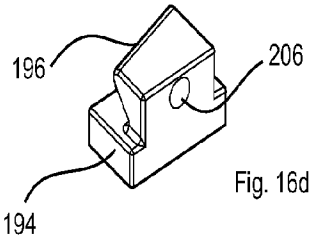
Figure 16E:
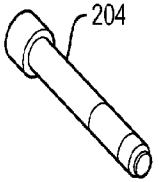
Figure 16A:
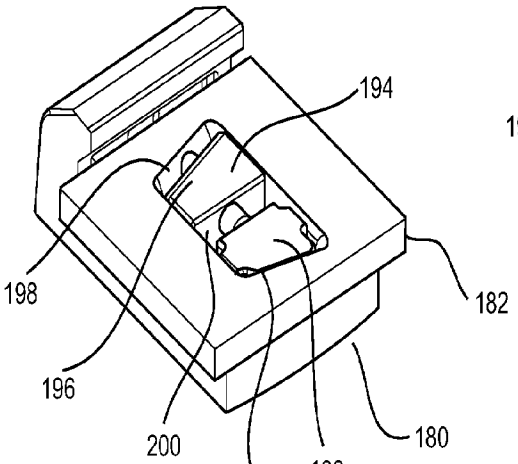
Figure 16B:
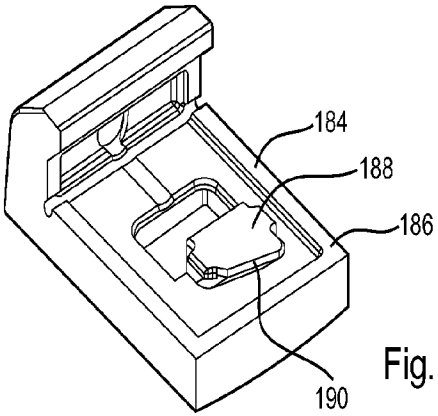

FIG. 16*a* shows an assembly 180 according to an embodiment of the present invention mounted to a corresponding receiver 182. The wear member 184 includes a raised bounding periphery 186. The locating member 188 has an oblique face 190 for engagement with a corresponding oblique face 192 on the receiver. Likewise, the attachment member 194 has an oblique face 196 angled in an opposite direction to that of the locating member, and which attachment member oblique face is arranged to engage with a corresponding oblique lip or face 198 of the receiver. These opposite angled oblique faces form a trapezium arrangement within the aperture 200 of the receiver and ensure that the wear member is biased sideways to positively engage towards the long side 202 of the trapezium and thereby lock in place. The bolt 204 is threaded into the aperture 206 of the attachment member 194 per other embodiments described. The combination of tapered and oblique faces of the respective locating and attachment members allows the wear member to take a greater load on one side than the other.

Figure 17:
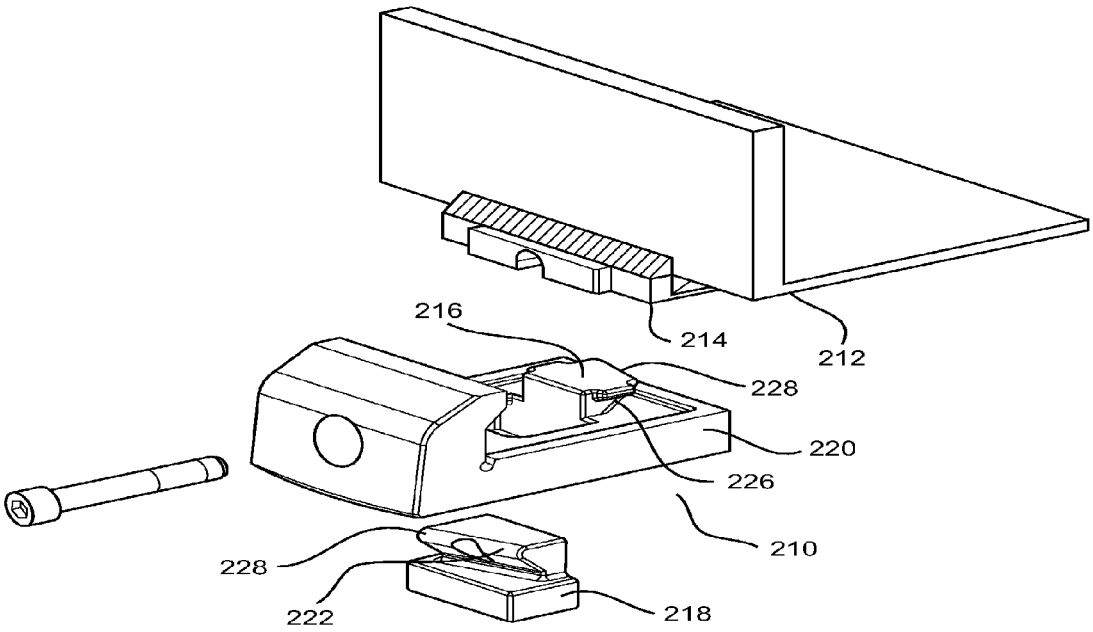
FIG. 17 shows an exploded view of a wear member assembly according to a further embodiment of the present invention.

FIG. 17 shows an exploded view of the components of the assembly 210 and bucket corner 212 mounted receiver 214. The components are similar to those shown in FIGS. 16*a* to 16*e* though the locating member 216 on the wear member 220 is narrower than the attachment member 218. The attachment member 218 has respective tapered 224 and oblique 222 faces forming a respective attachment member compound face positive engaging mechanism to engage within the trapezium shaped aperture in the receiver. Likewise, the locating member 216 has respective tapered 228 and oblique 226 faces forming a respective locating member compound face positive engaging mechanism to engage within the receiving member aperture. The combination of compound faced locating and attachment members causes the wear member to forcibly bias to one side of the receiving member aperture as they impinge against associated compound faces of the receiving member.

Figure 18A:
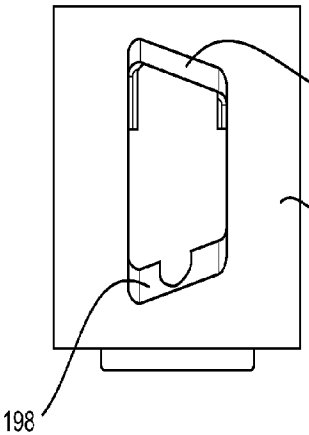
FIGS. 18*a* to 18*e* show various views of a receiver (adapter) according to a further embodiment of the present invention, the receiver having tapered and oblique contact portions or faces.
Figure 18B:
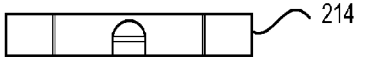
Figure 18C:
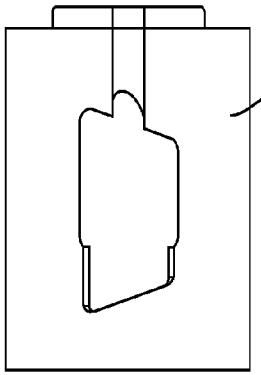
Figure 18D:
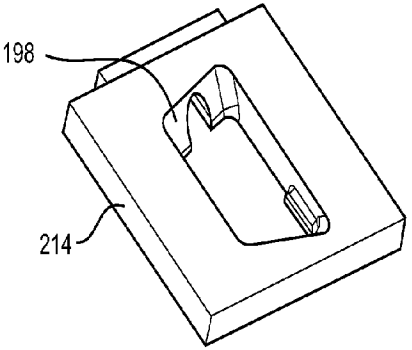
Figure 18E:
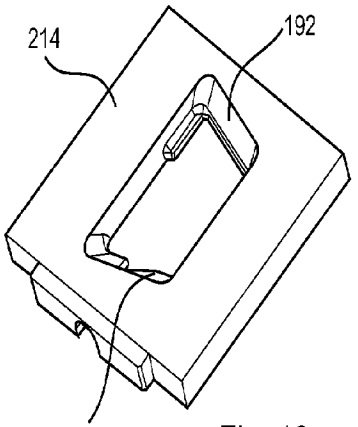

FIGS. 18*a* to 18*e* show various views of a receiver 214 for releasably retaining the wear member assembly 210 of FIG. 17. FIG. 18*e* shows detail of the tapered and oblique faces 192,198 on the receiver for respectively engaging with the locating member and attachment member tapered and oblique faces.

Figure 19:
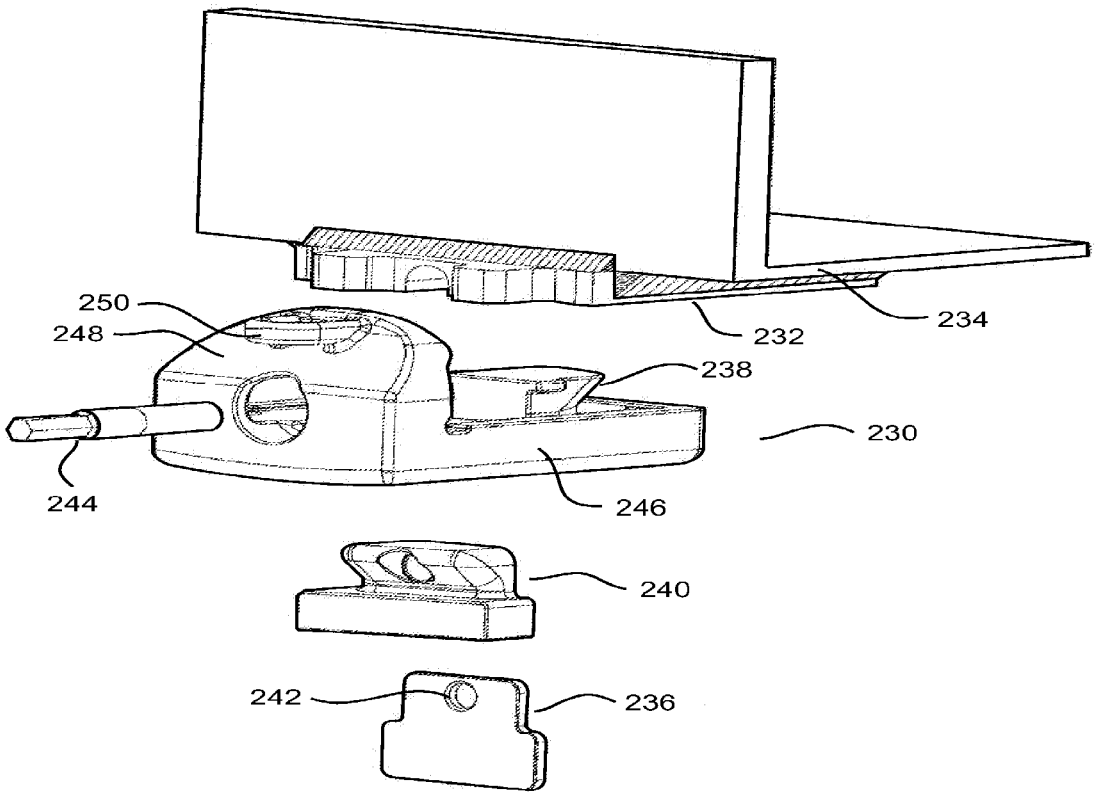
FIG. 19 shows an exploded view of an alternative embodiment of the present invention for mounting to a corner of an earth moving bucket.
Figure 20:
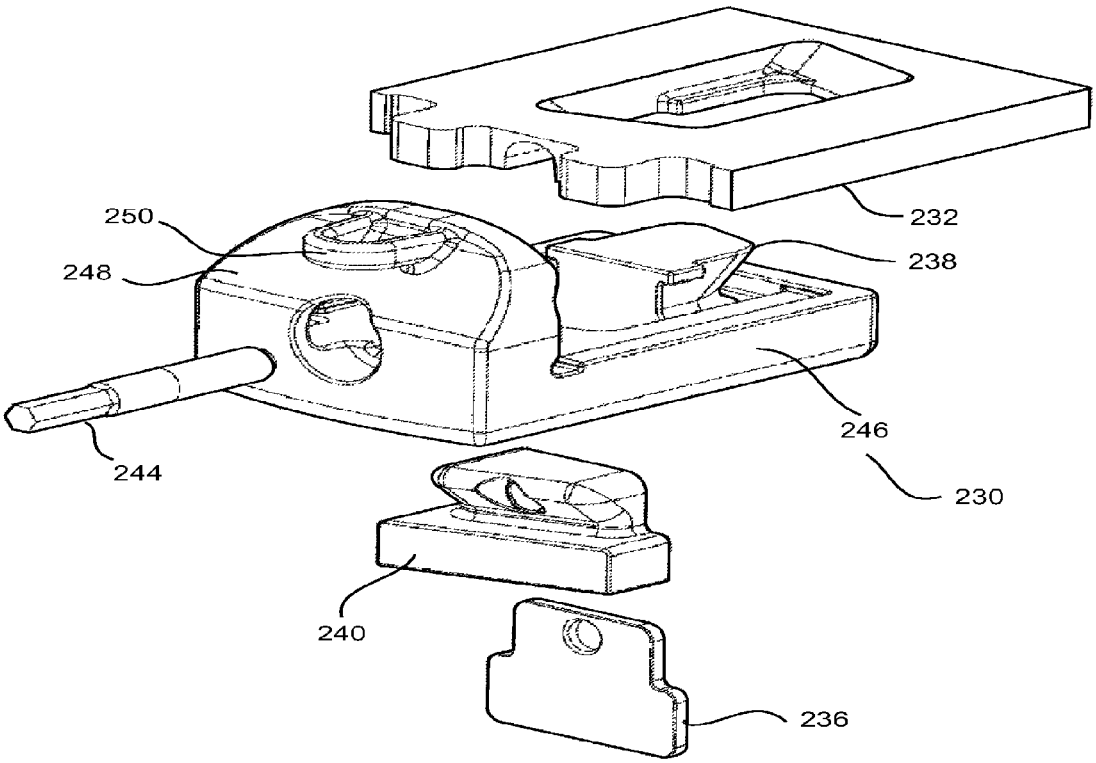
FIG. 20 shows an exploded view of a further alternative version of the present invention.

FIGS. 19 and 20 show exploded views of an alternative embodiment of an assembly 230 of the present invention for mounting to a receiver 232 welded adjacent a corner 234 of an earth moving apparatus member, such as a bucket. This embodiment includes a spacer for positioning between the locating 238 and attachment 240 members. The spacer includes an aperture 242 for receiving therethrough a fastening means (e.g. bolt) 244. In this embodiment, the wear member 246 side body portion 248 has a lifting or positioning member 250, such as a loop (shown) or other projection, such as a hook or a recess. The spacer helps fill the space between the locating member and the attachment member and thereby prevent or reduce ingress of soil, rock or other contaminants into the assembly.

Figure 21:
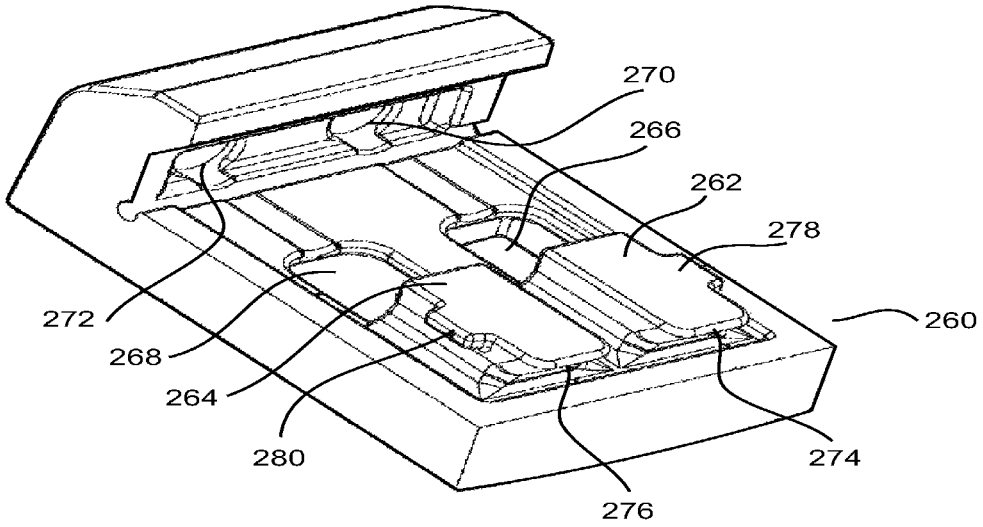
FIGS. 21 and 22 show alternative wear members with multiple locating members and capacity to receive multiple corresponding attachment members, the version in FIG. 21 having locating members with tapered faces and the version in FIG. 22 having locating members with tapered and oblique faces.

FIG. 21 shows a wear member 260 according to an alternative embodiment of the present invention. In such embodiments, the wear member includes multiple locating members 262,264. Each locating member may have a corresponding aperture 266, 268 adjacent thereto for receiving a respective attachment member (not shown). Alternatively, a single wide aperture may be provided that allows a single or multiple split attachment member(s) to be inserted therethrough. The single or multiple attachment member(s) has/have corresponding apertures therethrough to receive the respective fastening means (not shown). The wear member 260 has respective multiple front apertures 270, 272 for the fastening means. In the embodiment shown, the locating members have tapered front contact faces 274,276, and each has a single side projection 278,280 for engagement with respective side projections on the receiver. It will be appreciated that the receiver may have multiple apertures therethrough to receive the respective locating members and attachment members.

Figure 22:
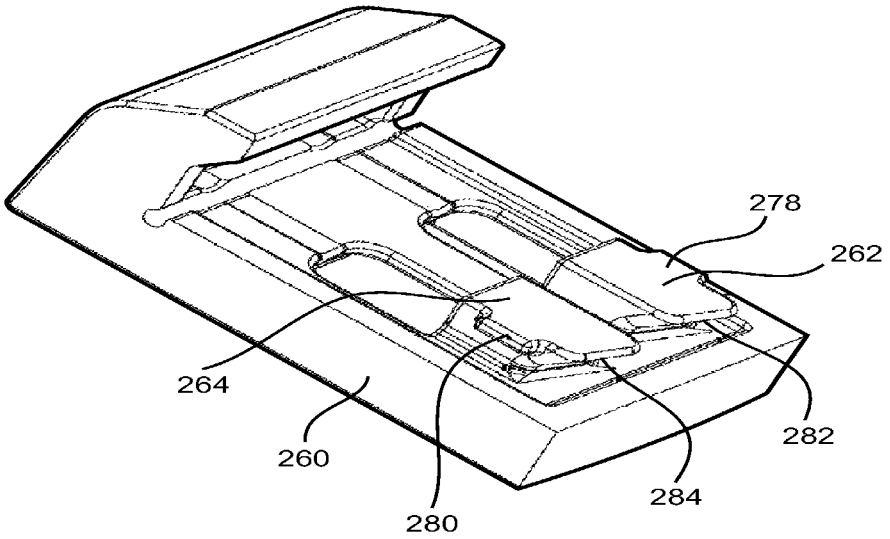

FIG. 22 shows an alternative embodiment of the wear member with tapered and oblique multiple contact faces 282, 284. These oblique faces are angled in the same direction so that the wear member is biased to one side relative to the receiver. The combination of tapered and oblique faces of the respective locating and attachment members allows the wear member to take a greater load on one side than the other. The raised edge around the periphery of the main body of the wear member should preferably fully mate against the underside of the receiver in order to best transfer impact forces to the receiver and thence to the bucket.

The side projections on the locating member insert up over the 'wing' projections within the aperture of the receiver. A tight fit helps sustain impact during loading.

During tensioning of the bolt and nut within the wear member, the tapered face of the nut will push the wear member forward and upward. The wear member moves upward up against the underside of the receiver due to the tapering faces of the nut and the locating member acting on the receiver contact points.

In use, the wear member is offered up to and initially engaged with the receiver (adapter). The attachment member (taper faced nut) is inserted into the wear member aperture from the underside of that member. Next, the bolt is inserted in through the front aperture of the wear member and rotated to engage with the nut. Tensioning the nut and bolt by rotating the bolt causes the nut to engage with the front internal part of the receiver. The bolt also forces the locating member away to engage with the rear internal part of the receiver. This tensions the wear member and holds it in place on the receiver. The angled (tapered) locating member (boss) and preferably the angled attachment member (nut) enable the wear member to withstand greater loads. The oblique faces on each also allow greater loads on one preferred side of the wear member.

The receiver may have one or more protrusions from a front thereof which, in use, engage into corresponding one or more recesses in the rear of the side body of the wear member. The assists in preventing the wear member moving and helps transfer frontal loads to the bucket.

The locating wings (side protrusions) on the locating member engage above side protrusions from the receiver into the receiver recess and allow the wear member to initially suspend from the receiver until the nut and bolt are inserted and engaged.

It will be appreciated that left and right hand wear member, nut, locating member and receiver may be required to accommodate the oblique face embodiments depending on their position on the bucket.

Figure 23:
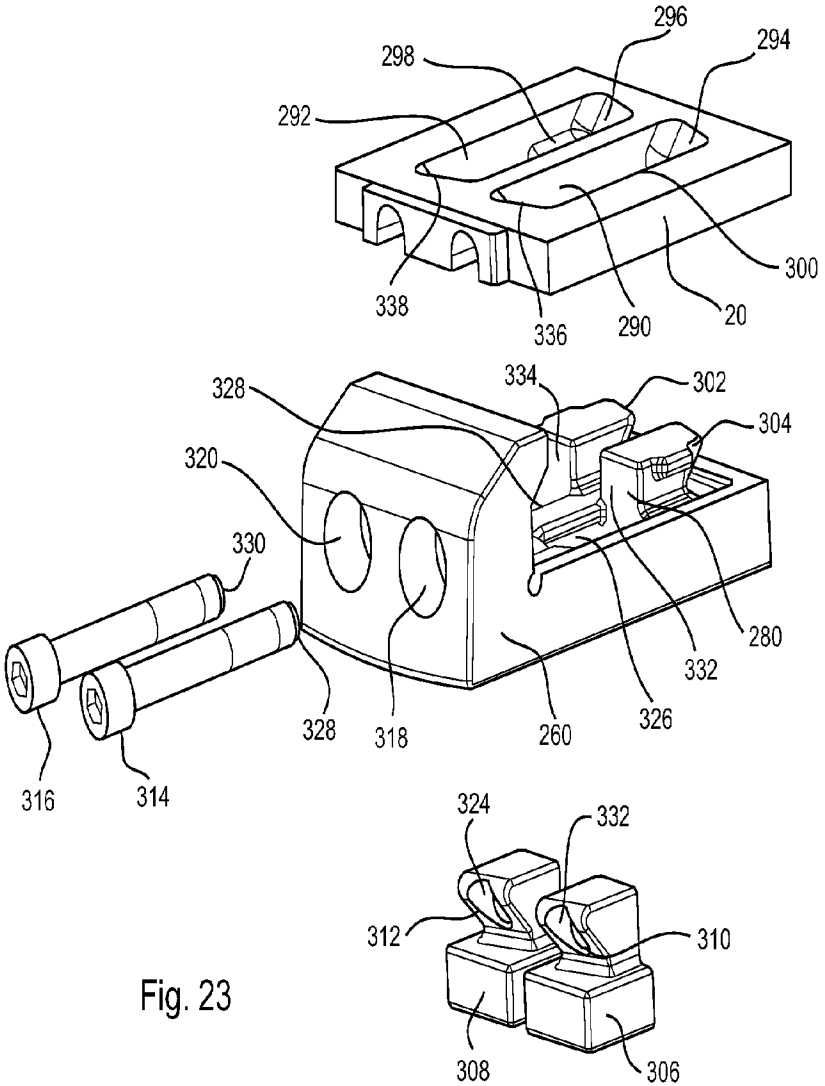
FIG. 23 shows an exploded perspective view of a wear member with multiple locating members and corresponding multiple attachment members and multiple fastening means, being an arrangement for releasably mounting the wear member to a receiving member, being an assembly according to an embodiment of the present invention.

FIG. 23 shows the wear member 260 of FIGS. 21 and 22 in an exploded perspective view of an assembly according to an embodiment of the present invention. A receiving member has multiple apertures 290,292. Each said aperture 290,292 is arranged to receive therein a corresponding one of the locating members 280,278. Each aperture has a compound angle contact face 294,296 for contact with the corresponding compound contact face 304,302 (e.g. tapered and oblique multiple contact faces 282,284) of the respective locating member 262,264. Each of the receiving member apertures 290,292 has a projecting portion 298,300 for supporting the corresponding projecting portion 278,280 of the respective locating member 262,264. The corresponding twin attachment members 306,308 have compound angled faces 310,312, with the oblique angle in an opposite direction to that of the respective locating member. When the wear assembly is assembled, the twin fastening means (bolts 314,316) extend through apertures 318,320 in the front of the wear member. These threadingly engage through respective threaded apertures 322,324 of the attachment means once the attachment means have been inserted into the respective apertures 326,328 in the main body portion of the wear member 260. Distal ends of the bolts 328,330 impinge against a contact face 332,334 on the respective locating member. Further fastening causes the attachment members to travel towards the side body portion of the wear member and thereby engage against the forward edges or faces 336,338 of the apertures 290,292 in the receiving member 20. Contact between the respective compound faces (tapered and oblique) causes the wear member 260 to bias to one side of the receiving member and thereby positively locate and assist in transferring load forces more efficiently and effectively to the earth moving apparatus.

Figure 24A:
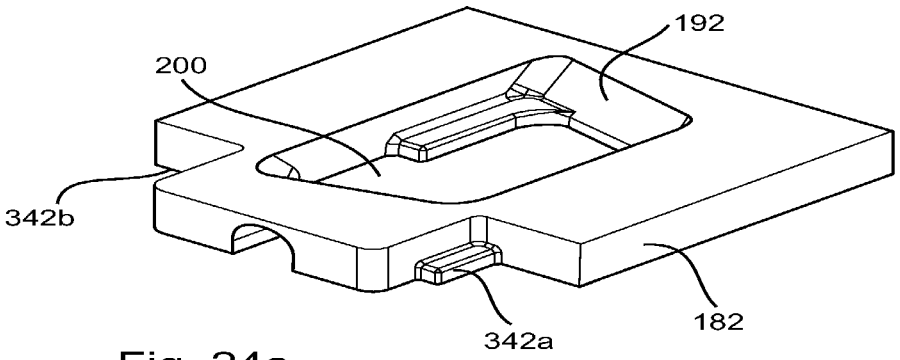
FIGS. 24*a* and 24*b* show a respective receiver (FIG. 24*a*) and wear member (FIG. 24*b*) according to a further embodiment of the present invention incorporating additional locating means aiding installation of the wear member.
Figure 24B:
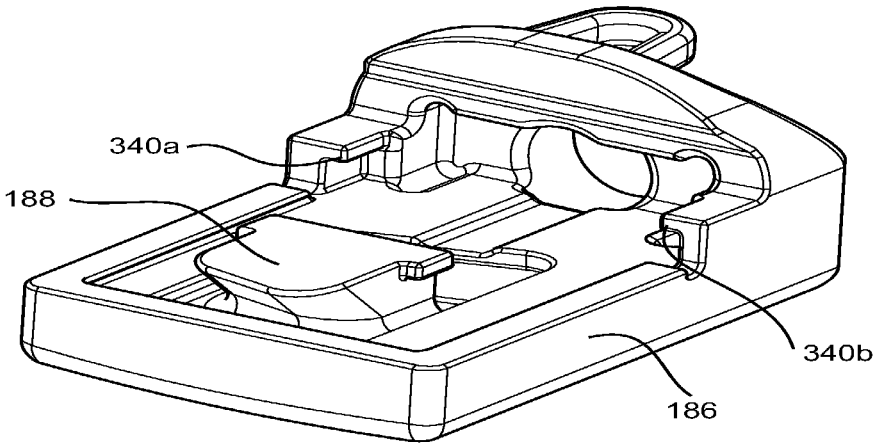

FIGS. 24*a* and 24*b* show an alternative embodiment of the wear member and receiver of the assembly. The wear member 186 and receiving member (receiver) 182 are similar to those shown in respect of FIGS. 16*a* to 16*c*. The wear member 186 has the single locating member 188 with compound angled and tapered face to locate against a corresponding surface 192 forming a part of the aperture 200 in the receiving member. In this embodiment, the wear member 186 includes further installation engagement portions 340*a*, 340*b* each arranged and configured to engage with a respective installation receiving portion 342*a*,342*b* on the outer periphery of the receiving member 182. This arrangement assists in initially locating and supporting the wear member when installing the wear member to the receiving member. It will be appreciated that the wear member and corresponding receiving member (receiver) can be of any configuration falling within the scope of the present invention, and as shown in the accompanying figures and described above, though not limited to the specific embodiments shown and described in this application. Thus, the installation engagement and receiving portions can be provided on any embodiment of the present invention. When the wear member is initially mounted to the receiving member, and the locating member is placed into the aperture, the installation engagement portions include shoulders that are supported on the installation receiving portions that project from the body of the receiving member. Thus, width the locating member within the aperture of the receiving member and its leading face contacting the support face on the receiving member, and the installation engagement portions in place on the installation receiving portions, the wear member is initially supported on the receiving member and thereby on the lip or edge of a bucket of earth moving equipment. This feature helps support the wear member on the receiving member until the attachment mechanism with its attachment member(s) is operated to lock the wear member into place against the receiving member. The installation engagement portions also help transfer load forces to the receiving member, and thereby to the bucket,

The invention claimed is:

1. A wear member assembly providing attachment of a wear member to a wear member receiver on an outer surface of an earth moving apparatus member, the wear member assembly comprising:

a wear member including at least one aperture;

a wear member receiver having at least first and second contact portions and at least one aperture to receive at least one wear member locating member of the wear member;

a releasable attachment mechanism arranged to releasably attach the wear member to the receiver, including at least one moveable attachment member and at least one respective fastening means, each said at least one aperture being arranged to receive therethrough at least part of a respective one of the at least one wear member attachment member, each of the fastening means being arranged upon actuation to move the associated attachment member to apply a retaining force to one of the contact portions of the wear member receiver and to cause the respective wear member locating member to apply a retaining force to the other of the contact portions of the wear member receiver; and at least one of the wear member receiver first and second contact portions having a tapered face and the corresponding wear member locating member or attachment member having a taper, such that contact between the wear member locating member taper or attachment member taper and a corresponding one of the wear member receiver tapered contact portions causes the wear member to positively locate to the receiver and releasably retain the wear member to the outer surface of the earth moving apparatus member.

2. An assembly as claimed in claim 1, wherein the earth moving apparatus member is an excavator bucket and the outer surface includes a corner or heel of the excavator bucket.

3. An assembly as claimed in claim 1, wherein the wear member is a heel shroud.

4. An assembly as claimed in claim 1, wherein at least one of the wear member locating member(s) and the attachment member(s) has a respective tapered contact face arranged to contact a respective wear member receiver tapered contact face, such that actuation of the fastening means causes the locating member and the attachment member to lift and positively retain the wear member to the wear member receiver.

5. An assembly as claimed in claim 4, wherein both of the wear member locating member(s) and the attachment member(s) have respective tapered contact faces arranged to contact their respective wear member receiver tapered contact face.

6. An assembly as claimed in claim 1, wherein the wear member aperture extends through a main body portion of the wear member.

7. An assembly as claimed in claim 1, wherein the at least one said wear member locating member includes a bearing surface against which a portion of the respective fastening means bears and applies a force for releasably fastening the wear member to the receiver.

8. An assembly as claimed in claim 1, wherein the at least one fastening means includes one or more screw thread fasteners.

9. An assembly as claimed in claim 1, wherein the through aperture of the wear member retainer receiver is bounded at opposed sides thereof by side portions, at least one of said side portion including a respective projection portion, the respective projection portion arranged to support a corresponding wear member locating member projection.

10. An assembly as claimed in claim 9, wherein the projection portion of the respective side portion is formed by a step in the material of the respective side portion.

11. An assembly as claimed in claim 9, wherein, when the assembly is mounted to the wear member receiver, the projection portion(s) initially locate the wear member to the wear member receiver and subsequently initially hold the wear member in place until the at least one fastening means is tightened.

12. An assembly as claimed in claim 1, wherein the at least one wear member attachment member includes one or more respective locking or moving members.

13. An assembly as claimed in claim 12, wherein the one or more locking or moving members includes at least one sliding nut or threaded fastener member.

14. An assembly as claimed in claim 1, wherein the wear member receiver is welded or otherwise fastened to the underside of the earth moving apparatus member.

15. An assembly as claimed in claim 1, wherein the wear member includes a wear member body having a main body portion that, when the assembly is mounted to the wear member receiver, mounts to an underside of the earth moving apparatus, and a side body portion that, extends at least partway along or up a side of the earth moving apparatus.

16. An assembly as claimed in claim 1, wherein the wear member includes multiple said locating members.

17. An assembly as claimed in claim 16, wherein each of the multiple locating members includes a respective tapered face.

18. An assembly as claimed in claim 16, wherein the wear member includes multiple apertures, each said aperture being arranged to receive therethrough a respective one of said fastening means.

19. An assembly as claimed in claim 16, wherein each locating member has one or more projections to aid in locating and initially retaining the wear member in position until the wear member is fastened using the respective fastening means.

20. An assembly as claimed in claim 1, wherein the wear member includes at least one wear member side portion having a respective protruding portion to project, when the assembly is mounted to the wear member receiver, into a corresponding recess in the wear member receiver or earth moving apparatus member.

21. An assembly as claimed in claim 1, wherein at least one of said at least one locating member has an oblique face.

22. An assembly as claimed in claim 21, wherein the oblique face is the respective tapered face forming a compound angle contact face, the wear member receiver having a respective corresponding oblique contact face.

23. An assembly as claimed in claim 1, wherein the wear member includes at least one shoulder portion extending along one or more respective sides of the aperture.

24. An assembly as claimed in claim 23, wherein the at least one shoulder portion, when the assembly is mounted to the wear member receiver, is arranged to transfer shock and/or load through the wear member to the earth moving apparatus.

25. An assembly as claimed in claim 24, wherein the wear member receiver includes a corresponding at least one shoulder portion receiving recess.

26. An assembly as claimed in claim 1, wherein the wear member includes an attachment point, mounting grip or knuckle extending forward of wear member for lifting/handling the wear member.

27. An assembly as claimed in claim 1, wherein the at least one locating member includes side projections to engage with the receiver.

28. An assembly as claimed in claim 1, wherein the receiver includes a platform area around the aperture, the aperture receiving therethrough the at least one locating member.

29. An assembly as claimed in claim 1, further including at least one spacer located, when the assembly is mounted to the wear member receiver, between a respective said locating member and the respective said attachment member.

30. An assembly as claimed in claim 29, wherein at least one of said spacer has an aperture through which the fastening means passes.

31. An assembly as claimed in claim 1, wherein the wear member includes at least one installation engagement portion and the receiving member includes a corresponding at least one installation receiving portion, cooperation of the installation engagement portion(s) with the respective installation receiving portions additionally supporting the wear member on the receiving member.

32. A wear member assembly for attachment to a wear member receiver provided on an outer surface of an earth moving apparatus member, the wear member assembly comprising:

a wear member, the wear member receiver having at least first and second contact portions and an aperture to receive a wear member locating member of the wear member assembly, the locating member including side projections to engage with the receiver;

a releasable attachment mechanism arranged to releasably attach the wear member assembly to the wear member receiver;

a moveable attachment member and a fastening means, such that actuation of the fastening means moves the attachment member to apply a retaining force to one of the contact portions of the wear member receiver to cause the wear member locating member to apply a retaining force to the other of the contact portions of the wear member receiver; and at least one of the wear member receiver first and second contact portions having a tapered face and the wear member locating member or the attachment member has a corresponding taper such that contact between the wear member locating member taper or the attachment member taper and a corresponding one of the wear member receiver tapered contact portions causes the wear member to positively locate to the receiver thereby releasably retaining the wear member to the outer surface of the earth moving apparatus member.

33. An earth moving apparatus member having an outer surface, the earth moving apparatus comprising:

a wear member receiver located on the outer surface, the wear member receiver having at least first and second contact portions and an aperture to receive a locating member of a wear member, the locating member including side projections to engage with the receiver; and a wear member assembly including the wear member, the wear member assembly being arranged to releasably attach to the wear member receiver on the earth moving apparatus member, the wear member assembly further including a releasable attachment mechanism arranged to releasably attach the wear member to the wear member receiver, a moveable attachment member and a fastening means such that actuation of the fastening means moves the attachment member which causes the attachment member to apply a retaining force to one of the first and second contact portions of the wear member receiver and causes the wear member locating member to apply an opposite retaining force to the other of the first and second contact portions of the wear member receiver, at least one of the wear member receiver first and second contact portions being tapered and the wear member locating member or attachment member having a corresponding taper such that contact between the wear member locating member tapered face or attachment member tapered face and a corresponding one of the tapered first or second contact portions of the receiver causes the wear member to positively locate to the wear member receiver thereby releasably retaining the wear member to the outer surface of the earth moving apparatus member.

* * * * *